United States Patent [19]

Imhoff

[11] Patent Number: 4,743,206

[45] Date of Patent: May 10, 1988

[54] CHILD-SAFE OUTLET PLATE

[76] Inventor: Karl Imhoff, 7538 31st Ave., Kenosha, Wis. 53142

[21] Appl. No.: 928,513

[22] Filed: Nov. 10, 1986

[51] Int. Cl.[4] ..... H01R 13/44

[52] U.S. Cl. ..... 439/137; 439/139; 439/143; 439/536; 174/67

[58] Field of Search ..... 339/36, 37, 38, 39, 339/40, 41, 122, 123, 75, 184; 174/66, 67

[56] References Cited

U.S. PATENT DOCUMENTS

| | | | |
|---|---|---|---|
| 2,641,627 | 6/1953 | Lewis | 174/67 |
| 2,710,382 | 6/1955 | Fitzpatrick et al. | 339/40 |
| 3,865,456 | 2/1975 | Dola | 174/67 |
| 3,956,573 | 5/1976 | Meyers et al. | 339/36 |
| 4,302,624 | 11/1981 | Newman | 339/36 |
| 4,640,564 | 2/1987 | Hill | 339/36 |

FOREIGN PATENT DOCUMENTS

| | | | |
|---|---|---|---|
| 467936 | 6/1937 | United Kingdom | 339/41 |

*Primary Examiner*—Gil Weidenfeld
*Assistant Examiner*—David Pirlot
*Attorney, Agent, or Firm*—Peter N. Jansson, Ltd.

[57] ABSTRACT

An improved child-safe outlet cover including a main plate defining receptacle opening(s), a shield on the main plate for each opening having first and second portions, such shield movable between use and non-use positions in which the first and second portions, respectively, cover the receptacle openings, the first portion having prong openings aligned with the receptacle slots in the use position, and means biasing the shield to the non-use position. Preferred embodiments include locking pins and a number of structural variations providing important advantages.

20 Claims, 3 Drawing Sheets

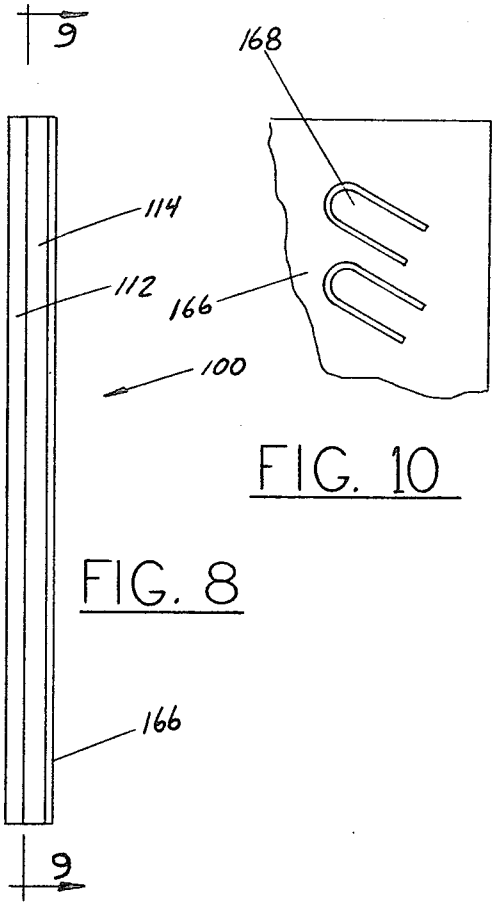
FIG. 10
FIG. 8
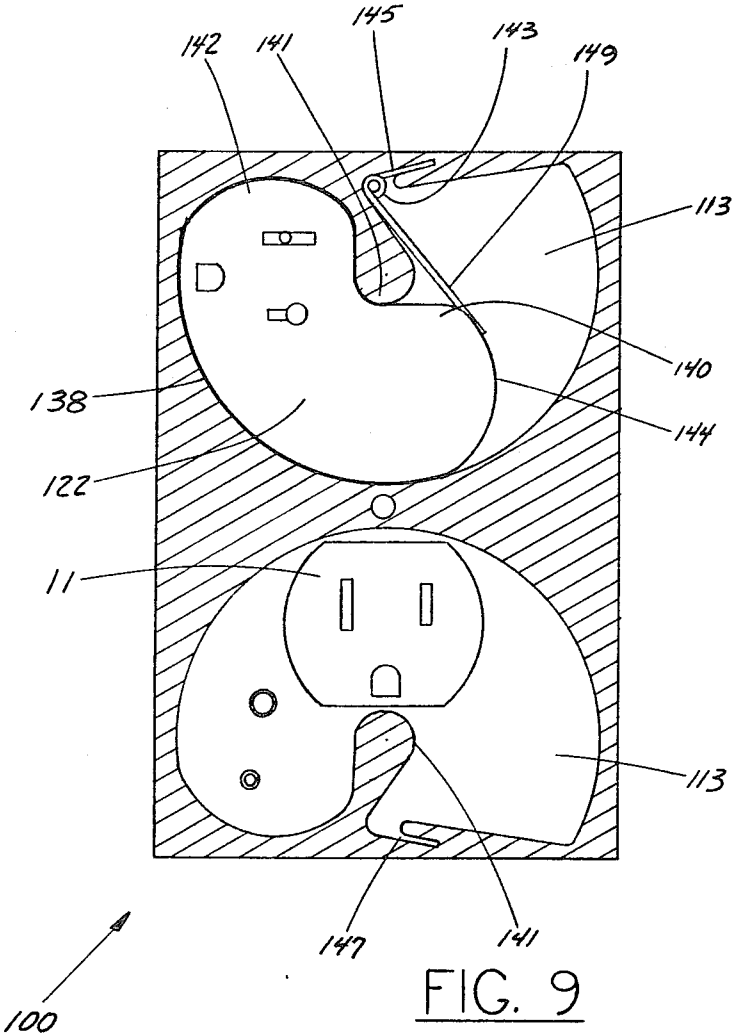
FIG. 9

CHILD-SAFE OUTLET PLATE

FIELD OF THE INVENTION

This invention is related generally to electrical outlet receptacle covers and, more particularly, to electrical outlet covers having safety devices.

BACKGROUND OF THE INVENTION

Electrical plug receptacles used as wall outlets usually have contacts which are continuously energized, and because of this represent a source of danger. Electrical shocks and short circuits can occur upon the insertion of a wire or other metal object into one of the slots which are intended to receive plug prongs. Children of tender years usually fail to appreciate this danger and are often at risk due to the own curiosity.

Many devices have been developed to render electrical wall outlets safe for children, that is, "child-safe." Many of these involve simple non-conductive plug covers, sometimes having prongs like electric plugs, which are removed prior to insertion of an electric plug. One disadvantage of such devices is that too frequently it is difficult to remove such non-metallic covers, and very easy just to ignore covering an electrical wall outlet again when it is no longer in use. Furthermore, such devices provide no protection during plugging and unplugging.

Efforts have been made toward development of child-safe outlet cover assemblies which reclose automatically when the wall receptacle is not in use. Examples of such devices and other prior art include the following U.S. Pat. Nos.:

4,302,624 (Newman)
2,641,627 (Lewis)
4,584,430 (Belknap)
4,605,270 (Aslizadeh)
4,600,258 (Hu)
4,279,457 (Nickence)
4,206,957 (Ludwig et al.)
3,865,456 (Dola)
3,775,726 (Gress)
3,238,492 (Houston)
2,710,382 (Fitzpatrick et al.)
2,610,999 (Silver)
3,222,631 (Cohen).

Despite the efforts in development of child-safe outlet covers, a a variety of problems, disadvantages and shortcomings are present in prior art outlet covers and cover assemblies.

Devices requiring a specific locking action may not consistently be locked. Automatic locking is needed.

Many of the prior cover assemblies are complex and/or difficult to operate. For example, some devices require that an adult use two hands in order to insert an electric plug into a receptacle. This inconvenience may not be tolerated by an adult and discourages the use of the protective device. Furthermore, it is unsafe to use two hands when working with live electricity.

In other cases, relative ease of operation or simplicity of structure may be achieved with excessive compromise in childresistant capabilities. In some cases, shielding devices can be fairly easily moved to the side thus exposing the electric receptacles. Some shielding devices are at no time adequately locked in protective positions. In other cases, shields are inadequately attached to the remainder of the assembly, or inadequately held while in certain positions of operation.

In some devices of the prior art, movable shields are intended to be pivoted to positions beyond the edges of the cover plates on which they are mounted. This is unattractive and may allow a child to bend and break the shield away from the device.

In short, a number of problems need to be solved in an improved child-safe outlet cover.

OBJECTS OF THE INVENTION

It is an object of this invention to provide an improved child-safe outlet cover overcoming certain problems, shortcomings and disadvantages of the prior art.

Another object of this invention is to provide a child-safe outlet cover having improved child-safe qualities.

Another object of this invention is to provide an improved child-safe outlet cover which may be easily operated and yet provides excellent protection against improper receptacle access by young children.

Another object of this invention is to provide a child-safe outlet cover assembly having a shield well secured to the assembly regardless of the operational position of the cover.

Another object of this invention is to provide an improved child-safe outlet cover which is automatically locked upon removal of an electric plug.

Another object of this invention is to provide an improved child-safe outlet cover assembly having a receptacle shield which cannot be slid away from the receptacle by a young child.

Yet another object of this invention is to provide an improved child-safe outlet cover which may be operated easily by an adult using one hand.

Another object of this invention is to provide improved child-safe cover assemblies which may be installed without the services of a trained electrician.

Another object of this invention is to provide an improved child-safe outlet cover which, while including a locking mechanism, is simple in construction, requiring few parts.

These and other important objects will be apparent from the descriptions of this invention which follow.

SUMMARY OF THE INVENTION

This invention is an improved child-safe outlet cover assembly for electric receptacles overcoming certain problems and disadvantages of the prior art. The invention is a replacement for the standard wall-flush plate which defines at least one receptacle opening, and almost always two. The invention is made to be attached to the receptacle structure by a single screw, in the manner used to attach standard wall-flush plates.

The child-safe outlet cover of this invention includes a main plate defining a receptacle opening, and preferably two. When there are two receptacle openings, as is highly preferred, they are separated by a main plate center portion. Through this center portion (and, in highly preferred embodiments, through a raised member on the center portion) is a hole to receive the screw used to attach the child-safe outlet cover of this invention to the receptacle structure.

For each receptacle opening a shield is movably attached to the main plate, each shield having first and second portions. The shield is movable with respect to the main plate between a non-use position and a use position. In the non-use position, the second portion of the shield covers the receptacle opening and the first portion of the shield extends away from the opening. In the use position, the first portion of the shield covers the receptacle opening and the second portion extends away from the opening.

The first portion of the shield defines prong openings therethrough, arranged in the normal pattern of electric plug prongs. When the shield is in the use position, such prong openings are aligned with the electric receptacle slots. The shield is biased to the non-use position, and may be moved against the biasing force to its use position.

The periphery of each shield is preferably configured in various ways for various purposes. Each shield preferably has a periphery with an inner edge portion adjacent to the main plate center portion and an outer portion which is opposite the inner edge portion, and preferably includes means at a plurality of points along the shield periphery to hold it securely adjacent to the main plate. Such holding means includes holding means along the inner edge and holding means along the outer edge.

The inner edge holding means preferably includes a raised member which projects from the main plate center portion and has an undercut edge adjacent to and engaging the inner edge of the shield. Such raised portion is preferably integrally formed with the main plate.

The device also includes a pivot support means along the outer edge of the shield, to accommodate a pivoting motion of the shield with respect to the main plate. This may take various forms, as hereafter described.

Again referring to the characteristics of the inner edge of the shield, in highly preferred embodiments the inner edge of the shield extends along an arc. The inner edge arc is shaped such that the inner edge is immediately adjacent to the undercut edge of the raised member regardless of the pivot position of the shield. Furthermore, the inner edge of the shield has means, such as a cross-sectional beveled shape, for engaging the undercut edge along the length of the arc. This allows the shield to remain firmly in engagement with the raised member regardless of the rotational position of the shield.

The shield periphery preferably also has first and second end portions between its inner and outer edge portions, previously described. Each shield is preferably somewhat oval in shape. The first end portion is along the first portion of the shield, which has the aforementioned prong openings, and the second end portion is along the second portion of the shield. These end portions serve various functions in preferred embodiments of this invention.

In certain preferred embodiments, a first stop member is on the main plate positioned for engagement by the first end of the shield to stop its pivoting movement such that when the first end of the shield and such first stop member are in engagement, the shield is in its non-use position. Such first stop member is preferably undercut and the first end of the shield has means, such as a complementary beveled cross-section, engaging such undercut stop member, to secure the shield against the main plate.

In certain preferred embodiments, a second stop member is on the main plate positioned for engagement by the second end of the shield, and such engagement defines the use position of the shield, in which the prong openings of the first portion of the shield are in alignment with the receptacle slots. The second stop member and second end portion of the shield may have interengaging edge configurations, but such is not important since the electric plug, as well as the holding means along each of the inner and outer edges, serves to hold the shield firmly assembled with the main plate.

The aforementioned pivot support means may be in the form of a pivot pin pivotably attaching the shield to the main plate. A rivet may be used for this purpose, although other types of pivot pins may be used.

Alternatively, the pivot support means may be a pivot fulcrum on the main plate positioned to engage the outer edge of the shield, rather than extending through the shield.

At least in the latter case, the child-safe outlet cover of this invention further includes an outside plate which is parallel to and substantially coincident with the main plate. The main plate and such outside plate together define a chamber therebetween for each shield, such chamber serving to hold the shield in place against the main plate. More specifically, the chamber is shaped to limit the direction of movement of the shield and limit the orientation of the shield with respect to the main plate when shield and main plate are not pinned together by a rivet or other pivot pin.

Such outside plate defines an exposure opening therethrough which exposes both the first and second portions of the shield when the shield is in its non-use position. Such exposure opening preferably has edges which slightly overlap the shield to hold it properly in place in every position. Indeed, such overlapping forms the aforementioned undercut configuration which serves to hold the shield properly against the main plate.

The exposure opening through the cover plate can be small enough such that when the shield is in its use position all or more of the second portion of the shield will be hidden by the outside plate. However, such covering is not essential.

In embodiments including an outside plate as described, a pivot fulcrum may be in the form of a post-like structure which extends between the main plate and the outside plate, positioned as indicated for engagement by the outside edge of the shield. Such a structure can be in various cross-sectional shapes and sizes. It is important only that it provide a reference point for pivoting movement of the shield. Such fulcrum structure is preferably integrally formed with the main plate, but integral formation with the cover plate or securement in some other way may be used.

The cover plate may be heat sealed to the main plate and/ or the various parts projecting from it, or may be secured by other ways. The cover plate, like the main plate and the projecting portions, is preferably made of widely available plastics.

The aforementioned first and second stop means are also preferably integrally formed with the main plate, but in embodiments having a cover plate, as just described, integral formation with the cover plate is possible, although not preferred. Stop members in various embodiments may be secured in place to the the main plate in other ways as well.

Highly preferred embodiments of the invention include means locking each shield in its non-use position. Such locking means preferably include at least one pin used for locking the shield in its non-use position on the main plate. Each pin is movably secured to the main plate and positioned for engagement with one of the prong openings in the first portion of the shield when the shield is in its non-use position. Also included are means biasing such pin or pins toward engagement with such prong openings or openings. The most highly preferred embodiments include a pair of pins engaging the two principal prong openings in the main plate.

Such pins are pushed out of the prong openings in the shield when plug prongs are inserted into such prong openings in the shield. This frees the shield for pivoting movement from its non-use position to its use position. Such unlocking and pivoting motion can be carried out by one hand, using an electric plug as an implement to unlock and move the shield.

In one preferred embodiment, the means which biases the pin or pins into engagement with the prong openings in the shield is preferably a portion of the main plate itself. That is, each pin is preferably attached to or formed with the distal end of a tongue which is in the plane of, and is part of, the main plate.

In such embodiments, the plastic material used for forming the main plate provides the resiliency necessary to bias the pins into their locking positions. In some preferred embodiments, the pins, such tongue portions and the entire main plate, as well as the various stops and other projecting portions, are integrally formed of resilient plastic.

The locking pins are designed and configured such that their motion, when they are depressed during shield movement, is limited. The tips of such pins preferably never are depressed into the main plate, that is, to a position beyond flush with the surface of the main plate. Thus, the pins should themselves block access to the space behind the main plate.

The limitation of pin motion may be provided, in embodiments having pins integral with the main plate, by a stop bar or the like behind the main plate. Such stop bar, which preferably is behind a pair of pins, may itself be integrally formed with the main plate, or it may be attached to the back of the main plate in some other manner. Such stop bar or the like is small enough such that and is positioned such that it will not interfere with the outlet or the immediately surrounding area, including the wall or the outlet box. Pin movement may instead be limited by other means.

Other pin biasing means may be used, such as leaf springs or the like attached to the back of the main plate. In one preferred alternate embodiment, rather than having pins and tongues formed as part of the main plate, a separate back plate (or partial back plate) may be attached to the back surface of the main plate.

Such a back plate itself has tongue portions of springy (preferably plastic), and each tongue portion supports a pin on its end which extends through an opening in the main plate. This has the advantage of making the openings in the main plate, which are associated with the pins, rather small, which limits the possibility of gaining access to the space behing the main plate.

The first end portion of the shield periphery, previously described, preferably includes a beveled leading edge which is positioned and oriented to depress the pin or pins out of the path of movement of the shield during its return movement from its use position to its non-use position. Upon completion of such return movement of the shield to its non-use position, the prong openings in the first portion of the shield come into alignment with the locking pins, and such locking pins snap into the prong openings under the action of the biasing means. Such pins lock the shield into position until the next use of the receptacle.

When a pair of locking pins are used to engage a pair of prong openings in the shield, the locking pins are preferably of differing sizes and the prong openings are of different sizes to prevent engagement of a pin in the wrong prong opening as the shield pivots across the pins. More specifically, the pin which first encounters a prong opening during the movement of the shield from its use position to its non-use position is larger than the other pin and larger than such first-encountered opening such that the pin slides over the opening rather than engaging it. The pins preferably differ in width (diameter). The prong openings preferably differ in width, but of course are of appropriate size to accommodate the plug prongs.

The movable shields are, as previously indicated, biased to the non-use position, in which their second portions (which are without prong-receiving holes) cover the receptacle openings. Such biasing may be accomplished in various ways. The use of coil springs is preferred.

In embodiments having a pivot pin mounting each shield to the main plate, the pivot pin may be inserted through a coil spring with one end of the coil spring being against or secured to the main plate (or other structure secured thereto) and the other end being against or secured to the shield. Other configurations for such biasing means are possible as well. In embodiments having a pivot fulcrum rather than a pivot pin, a long-prong short coil or even a leaf spring can be used, although many other configurations are possible.

The improved child-safe outlet cover of this invention need not have and preferably does not have any part which extends at any point during its operation beyond the periphery of the main plate. More specifically, the first and second portions of each shield are both over the main plate in both the use and the non-use positions of the shield. This reduces opportunities for destruction of the child-safe outlet cover assembly, and also greatly improves the appearance of the device regardless of its use status.

BRIEF DESCRIPTION OF THE DRAWINGS

FIG. 8 is a side elevation of the device of FIG. 6.

FIG. 9 is a sectional plan view taken along section 9—9 of FIG. 8, with the shield and its spring biasing means removed from one portion thereof.

FIG. 10 is a fragmentary rear plan view of the device of FIGS. 6–9.

DETAILED DESCRIPTIONS OF PREFERRED EMBODIMENTS

Figure 2:
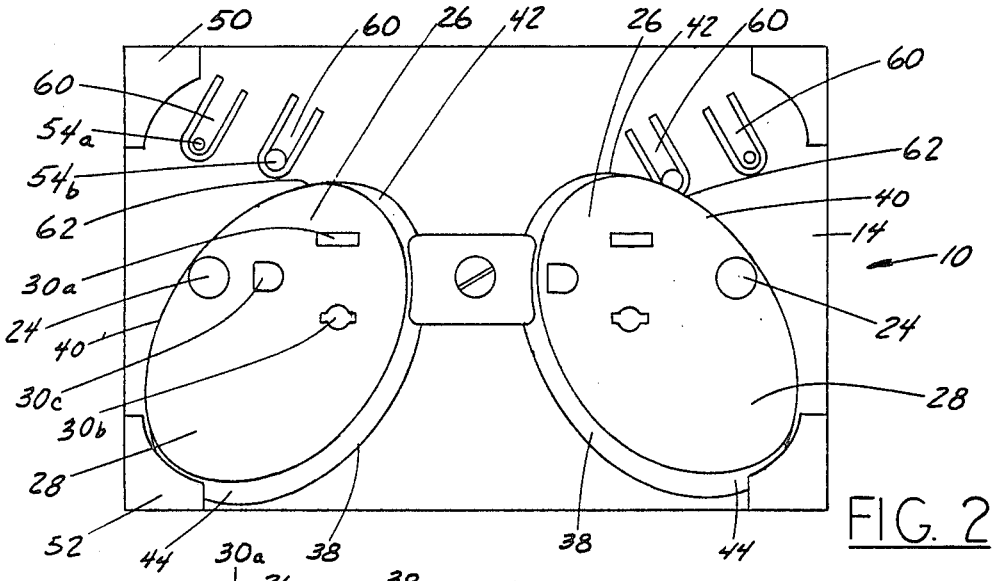
FIG. 2 is another plan view of the same device, but illustrating the device in its use condition. Electric plugs, however, are excluded from the view.

The figures illustrate two embodiments of the child-safe outlet cover of this invention—outlet cover 10 in FIGS. 1–5 and outlet cover 100 in FIGS. 6–10. Each is used with a pair of standard electric receptacles 11, one of which is shown in FIG. 9. Identical parts are identified by like numbers.

Outlet cover 10 includes a main plate 14 having a front surface 16 and a back surface 18. Main plate 14 defines a pair of receptacle openings 20, shown in FIG. 3 and illustrated by phantom lines in FIG. 1. Receptacle openings 20 are always covered by shields 22; one shield 22 covers each receptacle opening 20.

Figure 1:
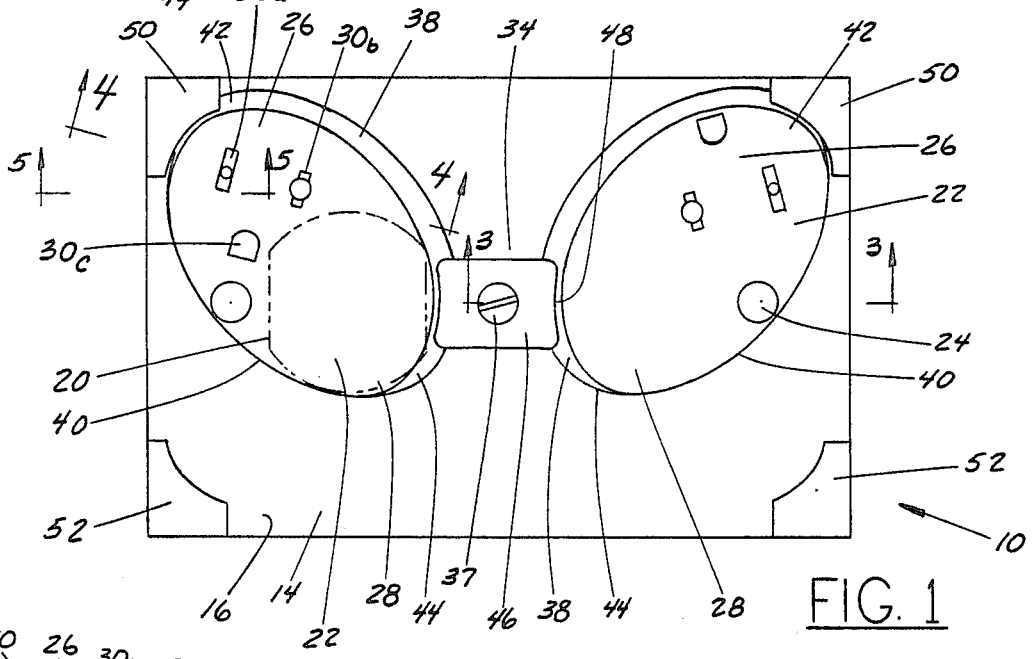
FIG. 1 is a plan view of a preferred child-safe outlet cover, shown in its non-use condition.

Each shield 22 is pivotably secured to main plate 14 by a rivet 24 and is movable between a non-use position, illustrated in FIG. 1, and a use position, illustrated in FIG. 2. Each shield 22 has a first portion 26 and a second portion 28. The range of movement of each shield 22 is limited such that first and second portions 26 and 28 never extend beyond the edge of main plate 14.

Second portion 28 of each shield 22 has no openings in it and completely covers its corresponding receptacle opening 20 when shield 22 is in the non-use position. This blocks access to the receptacle slots, including access by small children unaware of the danger. First portion 26 of each shield 22 defines prong openings 30(*a, b* and *c*), and covers its corresponding receptacle opening 20 when shield 22 is in the use position. In such use position, the three prong openings 30 are aligned with the slots in the standard electric receptacle opening, so that the prongs of an electric plug can extend through shield 22 into normal engagement with the electric receptacle.

Each shield 22 is biased to the non-use position shown in FIG. 1 by a coil spring 32 surrounding rivet 24. Each rivet 24 extends through a coil spring 32. Each coil spring 32 has one end engaged with or bearing against main plate 14 and the other end engaged with or bearing against shield 22 to bias it toward its non-use position.

The two receptacle openings 20 in main plate 14 are separated by a main plate center portion 34. A screw hole 36 extends through main plate center portion 34 and is used to attach child-safe outlet cover 10 to the receptacle structure in the normal wall flush manner by means of a small screw 37.

Each shield 22 has a periphery which includes an inner edge portion 38, an outer edge portion 40 which is opposite inner edge portion 38, and first and second end portions 42 and 44, respectively. Each shield 22 is held against and adjacent to main plate 14 by holding means along inner edge 38 and holding means along outer edge 40.

For child-safe outlet cover 10, the holding means along outer edge 40 is the aforementioned rivet 24, by which shield 22 is pivotably secured to main plate 14. The holding means along inner edge 38 is a raised member 46 projecting from front surface 16 of main plate center portion 34. Raised member 46, which is integrally formed with main plate center portion 34 and with main plate 14, has an undercut edge 48 on each side, each one adjacent to inner edge 38 of one of the shields 22. Undercut edges 48 serve to hold shields 22 against main plate 14, as hereafter explained. Screw hold 36 extends through raised member 46.

The inner edge 38 of each shield 22 forms an arc, as illustrated in FIGS. 1 and 2, the curvature of which is such that inner edge 38 engages undercut edge 48 of raised member 46 for all positions of shield 22, including the non-use position illustrated in FIG. 1, the use position illustrated in FIG. 2, and all positions therebetween. Furthermore, inner edge 38 of each shield 22 is beveled all along its length to facilitate its engagement with the corresponding undercut edge 48 of raised member 46 at all positions. Such engagement is illustrated best in FIG. 3.

As is apparent in the drawings, the aforementioned first end portion 42 of the periphery of each shield 22 is along first portion 26 of shield 22, and the second end portion 44 is along second portion 38 of shield 22. A first stop member 50 is attached to front surface 16 of main plate 14 in a position for engagement by first end portion 42 of each shield 22 to define the non-use position that shield 22. Likewise, a second stop member 52 is attached to front surface 16 of the main plate 14 in a position for engagement by second end portion 44 of each shield 22 to define the use position thereof. First and second stop members 50 and 52 are integrally formed with main plate 14, as is raised member 46.

Figure 4:
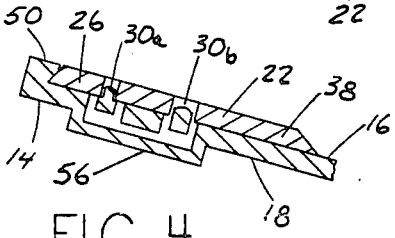
FIG. 4 is a fragmentary sectional view (without background) taken along section 4—4 as indicated in FIG. 1.
Figure 3:
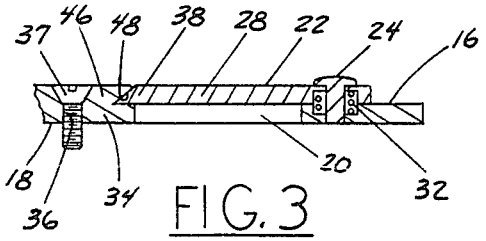
FIG. 3 is a fragmentary sectional view (without background) taken along section 3—3 as indicated in FIG. 1.

Each first stop member 50, as shown in FIG. 4, has an undercut configuration and each corresponding first end 42 has a beveled configuration. Such undercut and beveled configurations allow first end 42 to mate with first stop member 50, and thereby provide an additional means by which shield 22 is secured against main plate 14. Second end 44 of each shield 22 and second stop member 52 also have beveled and undercut configurations for the same purpose.

The first end 42 of each shield 22, however, is not beveled in the same manner at all positions therealong. A reverse beveling, as illustrated in FIG. 4, is along a small portion of each first end for a particular purpose hereafter described.

As illustrated best in FIGS. 2 and 4, first and second locking pins 54*a* and 54*b* are movably secured to main plate 14 and positioned for engagement with prong openings 30 in shield 22. There are a pair of such pins for each shield 22. Pins 54*a* and 54*b* are perpendicular to main plate 14 and are cylindrical, although other cross-sectional configurations are possible.

Each of the locking pins 54*a* and 54*b* is integrally formed on the distal end 58 of a tongue 60 which itself is integrally formed with main plate 14. Integrally formed on back surface 18 of main plate 14 in positions just behind pins 54*a* and 54*b* is a stop bar 56. See FIG. 4. Stop bar 56 limits the movement of pins 54*a* and 54*b* and their tongues 60, as earlier described, and blocks access to the space behind outlet cover 10.

Main plate 14, and all portions integrally formed therewith, including tongues 60 and first and second locking pins 54*a* and 54*b*, are preferably made of a resilient material such as a resilient plastic. The chosen material is such that after depressing pins 54*a* and 54*b* and their associated tongues 60, they spring back to their normal positions, shown in FIG. 4. In such positions, tongues 60 are in the plane of the main portion of main plate 14. The resilience of the material provides the means biasing pins 54*a* and 54*b* into openings 30*a* and 30*b*.

As already noted, each shield 22 has three prong openings. These include a first prong opening 30*a*, a wider and shorter prong opening 30*b*, and a ground prong opening 30*c*, locking pins 54*a* and 54*b* being positioned for engagement with first and second prong openings 30*a* and 30*b*, respectively. Each first locking pin 54*a* is smaller in diameter than each second locking pin 54*b*. The diameter of each second locking pin 54*b* is greater than the width of each first prong opening 30*a* such that prong opening will not receive locking pin 54*a*, but slide over it instead.

Therefore, when shield 22 is pivoting from its use position to its non-use position, second locking pin 54*b* will not engage first prong opening 30*a* (which would prevent continued return movement of shield 22 to the non-use postion), but return movement of shield 22 will continue until first end 42 engages first stop member 50. In that position, both of the pins 54*a* and 54*b* will engage their respective prong openings 30*a* and 30*b*.

Figure 5:
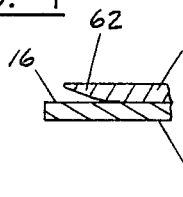
FIG. 5 is a fragmentary sectional view taken along section 5—5 as indicated in FIG. 5.

As earlier noted, each first end portion 42 of the periphery of each shield 22 has a leading edge portion 62 which is beveled in a manner allowing the pivoting return movement of shield 22 to depress locking pins 54*a* and 54*b* out of the path of movement of shield 22. This leading edge configuration is illustrated in FIG. 5. A camming action is provided by such leading edge.

Child-safe outlet cover 100 is another embodiment of this invention, differing from child-safe outlet cover 10 in a number of respects. Child-safe outlet cover 100, in addition to having a main plate 114 and a pair of shields 112, has an outside plate 112 which is parallel to and substantially coincident with main plate 114. That is, the peripheral edges of outside plate 112 and main plate 114 are aligned.

Outside plate 112 and main plate 114 together define a pair of chambers 113 therebetween each containing and limiting the movement of one of the shields 122. Shields 122 are made to fit in chambers 113, but not in a manner imposing significant frictional resistance to their movement. Shields 122 are preferably freely movable in chambers 113.

Figure 6:
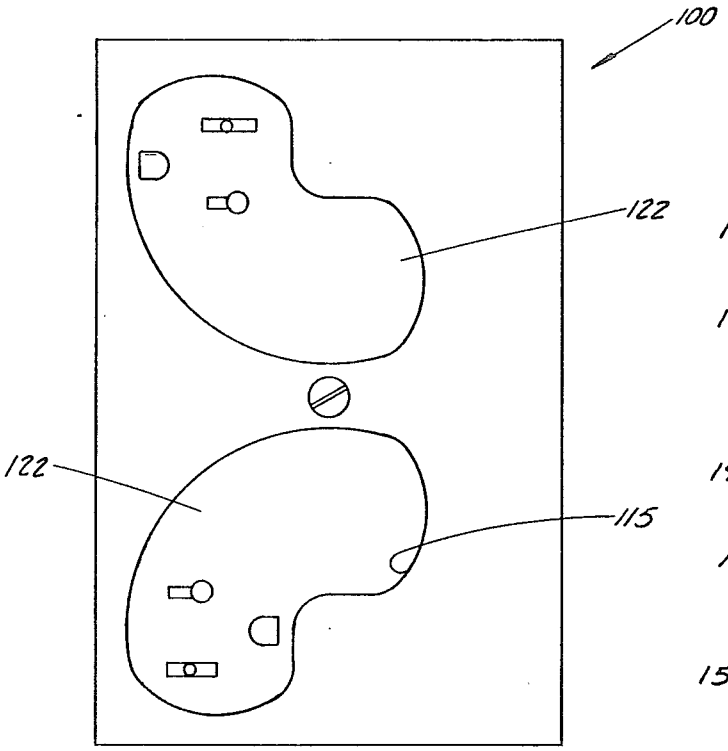
FIG. 6 is a plan view of another preferred child-safe outlet cover, shown in its non-use condition.

Outside plate 112 defines an exposure opening 115 for each shield 122. Each exposure opening 115 exposes nearly all of its corresponding shield 122 when it is in its non-use position, as illustrated in FIG. 6. Exposure opening 115, however, overlaps the edges of its corresponding shield 122 such that in all positions outside plate 112 holds shield 122 firmly against main plate 114.

Shields 122 of child-safe outlet cover 100 are similar to shields 22 of child-safe outlet cover 10 in a number of respects. However, they are not attached to main plate 114 by pivot pins, instead being held there by outside plate 112 as explained. And, rather than pivoting about pivot pins, shields 122 bear against and pivot around pivot fulcrums 141 which extend between main plate 114 and outside plate 112. Each shield 122 has an outer edge portion 140 which is shaped to receive and bear against a pivot fulcrum 141.

For each shield 122, a long-prong short coil spring 143, which is secured to main plate 114, biases each shield 122 to the non-use position, as best illustrated at the top of FIG. 9. Spring 143 includes a first end 145 engaged in a slot 147 formed in main plate 114, and a longer second end 149 bearing against second end portion 144 of the periphery of shield 122. The action of each spring 143 causes a shield 122 to pivot around pivot fulcrum 141 toward the non-use position. Shields 122, however, can be pivoted around pivot fulcrum 141 against the biasing force of spring 143 to the positions shown in FIG. 7, in which much of each shield is hidden by outside plate 112.

The periphery of each shield 122, in addition to including outer edge portion 140 and second end portion 144, includes an inner edge portion 138 and a first end portion 142. Inner edge 138, outer edge 140, second end 144, and much of first end 142 are perpendicular to the plane of main plate 114. The beveling illustrated in FIGS. 3 and 4 would serve no purpose, since the overlapping portions of outside plate 112 provide all the "undercut" necessary to hold shields 122, by contact on all portions of their peripheries, against main plate 114.

Figure 7:
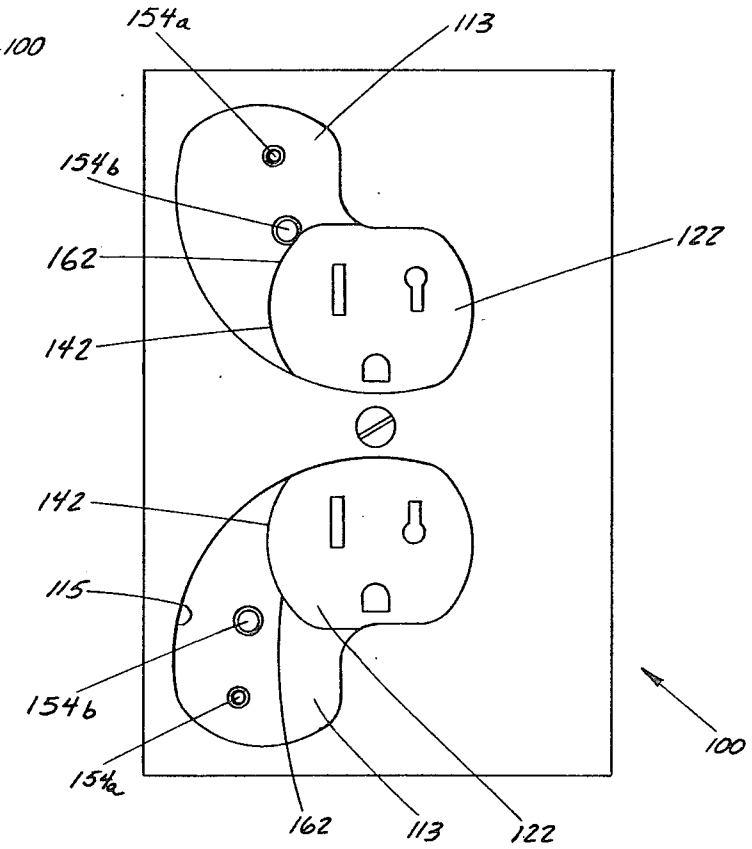
FIG. 7 is another plan view of the device of FIG. 6, but illustrating the use condition. As in FIG. 2, electric plugs are excluded from the view.

The only beveling along the peripheries of shields 122 is along their leading edge portions 162, shown in FIG. 7. The leading edge portion 162 of each shield 122 has the same beveling as the same comparable portion 62 of shield 22 of child-safe outlet cover 10, illustrated in FIG. 5.

As illustrated in FIG. 9, second end 144 of each shield 122 has a groove to receive a portion of second end 149 of spring 143. This holds spring 143 in place, preventing it from jamming between shield 122 and either outside plate 112 or main plate 114.

Child-safe outlet cover 100 has, for each shield 122, first and second locking pins 154*a* and 154*b*, which are somewhat similar to the pins earlier described. Likewise, each shield 122 has similar prong openings 30*a*, 30*b* and 30*c*. These cooperate in the manner previously described.

Pins 154*a* and 154*b* differ, however, from the pins illustrated in the embodiment of FIGS. 1–5 in that they are not integrally formed with the main plate and are not attached to or integrally formed with tongues which are integral with the main plate. Instead, the embodiment of FIGS. 6–10 has a back plate 166 secured against the back surface of main plate 114. Tongues 168 which are portions of backplate 166 not adhering to main plate 114 have distal ends to which pins 154*a* and 154*b* are attached. Tongues 166 function as means to bias pins 154*a* and 154*b* to positions of engagement with shield 122.

Pins 154*a* and 154*b* extend through small circular holes in main plate 114. Such holes are small enough that gaining access therethrough to positions behind main plate 114 is quite difficult, if not impossible. Although not shown, stop bars may also be used in the embodiment of FIGS. 6–10 to further reduce the possibility of gaining access to space behind main plate 114.

The embodiment of FIGS. 6–10, rather than having pivot fulcrums 141 as shown, could utilize pivot pins similar to the rivets shown in the embodiment of FIGS. 1–5. Other pivoting arrangements are possible as well.

As noted, the outlet covers of this invention can be made of various materials, resilient plastic materials being preferred. Suitable materials will be apparent to those skilled in the art who are familiar with this disclosure. Polyvinyl chlorides are particularly preferred. The movable shields can be made of materials different than those used for the main plate and outside plate. All principal parts are, of course, made of non-conductive materials.

A variety of biasing means can be used for the shields and for the locking pins. For the former, various leaf springs are another good choice. For the latter, leaf springs can be attached to the back of the main plate with the locking pins attached thereto or at least engagable therewith. After depression of the locking pins, such leaf springs would move them back into engagement with the prong openings. Such leaf springs can be formed with the main plate or can be separate pieces attached to the main plate. Many other variations in the biasing means are possible.

While the principles of this invention have been described in connection with specific embodiments, it should be understood clearly that these descriptions are made only by way of example and are not intended to limit the scope of the invention.

What is claimed:

1. In a child-safe outlet cover for wall-mounted electric receptacles with slots for receiving plug prongs, the improvement comprising:

a main plate having a wall-adjacent inner surface and an opposite outer surface and defining a receptacle opening;

a shield on the main plate outer surface having first and second portions, the shield being movable between a non-use position, in which the second portion covers the opening and the first portion extends from the opening, and a use position, in which the first portion covers the opening and the second portion extends from the opening;

the first portion defining prong openings aligned with the slots in the use position, the first shield portion being substantially fully exposed in both the use and the non-use positions such that all said prong openings are fully accessible in the shield non-use position;

means biasing the shield to the non-use position; and means engaging a prong opening in the shield in its non-use position whereby manual movement of the shield is precluded apart from disenggement of the engagement means from the shield.

2. The child-safe outlet cover of claim 1 wherein the first and second portions of the shield are both over the main plate in both the use and non-use positions of the shield, whereby the shield does not extend beyond the periphery of the main plate.

3. The child-safe outlet cover of claim 1 wherein the main plate has two receptacle openings separated by a main plate center portion and wherein there are two of the shields, each covering one of the two receptacle openings, whereby the child-safe outlet cover accommodates a pair of receptacles.

4. The child-safe outlet cover of claim 3 further comprising means locking each shield in its non-use position.

5. The child-safe outlet cover of claim 3 wherein each shield has a periphery with an inner edge portion adjacent to the main plate center portion and an opposite outer edge portion, and further comprising means along the periphery to hold the shield adjacent to the main plate, including at least holding means along the inner edge and holding means along the outer edge.

6. The child-safe outlet cover of claim 5 wherein the holding means along the inner edge comprises a raised member projecting from the main plate center portion, the raised member having an undercut edge adjacent to and engaging the inner edge.

7. In a child-safe outlet cover for a pair of adjacent electric receptacles which have slots for receiving plug prongs, the improvement comprising:

a main plate defining two receptacle openings separated by a main plate center portion;

two shields on the main plate, each covering one of the receptacle openings and having first and second portions, each shield being movable between a non-use position, in which its second portion covers the corresponding opening and the first portion extends from such opening, and a use position, in which the first portion covers such opening and the second portion extends from such opening, and each shield having a periphery with an inner edge portion and an opposite outer edge portion, the inner edge portion being adjacent to the main plate center portion;

each first portion defining prong openings alignable with receptacle slots when such shield is in its use position;

means biasing each shield to its non-use postiion;

means along the shield periphery, at least along the inner edge and along the outer edge, to hold the shield adjacent to the main plate, said inner edge holding means including a raised member which projects from the main plate center portion and has an undercut edge adjacent to and engaging the inner edge; and pivot support means along the outer edge of the shield.

8. The child-safe outlet cover of claim 7 wherein the pivot support means comprises a pivot pin pivotably attaching the shield to the main plate.

9. The child-safe outlet cover of claim 7 wherein:

the inner edge forms an arc such that the inner edge is immediately adjacent to the undercut edge regardless of its pivot position with respect to the pivot support means; and the inner edge has means for engaging the undercut edge along the length of the arc, whereby the shield remains in engagement with the raised member regardless of the rotational position of the shield.

10. The child-safe outlet cover of claim 9 further comprising:

each shield periphery having first and second end portions between its inner and outer edge portions, the first end portion being along the first portion of the shield and the second end portion being along the second portion of the shield;

a first stop member on the main plate positioned for engagement by the first end of the shield to define its non-use position; and a second stop member on the main plate positioned for engagement by the second end of the shield to define its use position.

11. The Child-safe outlet cover of claim 10 wherein the first stop member is undercut and the first end has means engaging such undercut stop member, thereby to secure the shield against the main plate.

12. The child-safe outlet cover of claim 9 wherein the pivot support means comprises a pivot fulcrum on the main plate positioned to engage the outer edge of the shield.

13. The child-safe outlet cover of claim 12 having an outside plate parallel to and substantially coincident with the main plate, the main and outside plates defining a chamber therebetween for each shield, said outside plate defining an exposure opening therethrough exposing both the first and second portions of the shield when the shield is in its non-use position.

14. The child-safe outlet cover of claim 13 wherein the pivot fulcrum extends between the main and outside plates.

15. In a child-safe outlet cover for a pair of adjacent electric receptacles which have slots for receiving plug prongs, the improvement comprising:

a main plate defining two receptacle openings separated by a main plate center portion;

two shields on the main plate, each covering one of the receptacle openings and having first and second portions, each shield being movable between a non-use position, in which its second portion covers the corresponding opening and the first portion extends from such opening, and a use position, in which the first portion covers such opening and the second portion extends from such opening;

each first portion defining prong openings alignable with receptacle slots when such shield is in its use position;

means biasing each shield to its non-use position; and means locking each shield in its non-use position, such locking means including at least one pin movably secured to the main plate and positioned for engagement with the prong openings in the shield when the shield is in its non-use position, and means biasing such pin toward engagement with the prong openings.

16. The child-safe outlet cover of claim 15 wherein each locking means comprises a pair of said pins.

17. The child-safe outlet cover of claim 15 further including a blocking member secured behind the main plate in position to limit the travel of the pins when such pins are depressed.

18. The child-safe outlet cover of claim 15 wherein the means for biasing the pin comprises a portion of the main plate itself.

19. The child-safe outlet cover of claim 15 wherein each shield has a periphery with an inner edge portion adjacent to the main plate center portion, an opposite outer edge portion, and a first end portion therebetween along the first portion of the cover plate, the first end portion having a beveled leading edge positioned to depress the at least one pin during movement of the shield from its use position to its non-use position.

20. The child-safe outlet cover of claim 19 further comprising:

a plurality of means along each shield to hold the shield adjacent to the main plate, such holding means including a raised member projecting from the main plate center portion and having an undercut edge adjacent to and engaging the shield inner edge;

pivot support means along the shield outer edge; and the shield inner edge forming an arc such that the inner edge is in engagement with the undercut edge regardless of the rotational position of the shield with respect to the pivot support means.

* * * * *